US009382705B2

(12) United States Patent
Braasch

(10) Patent No.: US 9,382,705 B2
(45) Date of Patent: Jul. 5, 2016

(54) STRUCTURAL ELEMENT FOR HEAT-INSULATING PURPOSES

(75) Inventor: Harald Braasch, Sinzheim (DE)

(73) Assignee: Schöck Bauteile GmbH, Baden-Baden (DE)

( * ) Notice: Subject to any disclaimer, the term of this patent is extended or adjusted under 35 U.S.C. 154(b) by 0 days.

(21) Appl. No.: 14/238,302

(22) PCT Filed: Aug. 13, 2012

(86) PCT No.: PCT/EP2012/065833

§ 371 (c)(1),
(2), (4) Date: Feb. 11, 2014

(87) PCT Pub. No.: WO2013/021070

PCT Pub. Date: Feb. 14, 2013

(65) Prior Publication Data

US 2014/0202102 A1 Jul. 24, 2014

(30) Foreign Application Priority Data

Aug. 11, 2011 (DE) ..... 10 2011 109 958
Aug. 11, 2011 (DE) ..... 10 2011 109 962

(51) Int. Cl.

| | |
|---|---|
| ***E04B 1/68*** | (2006.01) |
| ***E04B 1/76*** | (2006.01) |
| ***E04B 1/00*** | (2006.01) |
| ***E04C 2/284*** | (2006.01) |

(52) U.S. Cl.
CPC ..... *E04B 1/7604* (2013.01); *E04B 1/0038* (2013.01); *E04C 2/284* (2013.01)

(58) Field of Classification Search
CPC ..... E01C 11/02; E01C 11/04; E01C 11/06; E01C 11/12; E04B 1/6812; E04B 1/6813; E01D 19/06
USPC ..... 52/395, 396.03, 396.04, 396.06, 404.1, 52/404.3, 406.1–103.6, 406.1–406.3; 14/73.1, 73.5
See application file for complete search history.

(56) References Cited

U.S. PATENT DOCUMENTS 4,120,066 A * 10/1978 Leroux ..... 14/73.1
4,320,549 A * 3/1982 Greb ..... 14/73.5

(Continued)

FOREIGN PATENT DOCUMENTS

| | | |
|---|---|---|
| DE | 4009987 | 10/1991 |
| DE | 4103278 | 8/1992 |
| DE | 19640652 | 4/1998 |

(Continued)

*Primary Examiner* — William Gilbert
(74) *Attorney, Agent, or Firm* — Volpe and Koenig, P.C.

(57) ABSTRACT

Structural element for heat-insulating purposes between two structural parts, in particular between a building (A) and a projecting exterior part (B), formed of an insulating body (16), which is to be arranged between the two structural parts, and of reinforcing elements in the form of at least load-bearing elements (19*a*, 19*b*) which, with the structural element (10) in the installed state, run through the insulating body substantially horizontally and transversely to the substantially horizontal longitudinal extent of the insulating body, and can be connected at least indirectly to each of the two structural parts, wherein the load-bearing element is formed in more than one part and has at least one load-bearing web (19*a*, 19*b*) and a separate compressive-force-distributing element (20*a*, 20*b*) on at least one of its end sides (22*a*, 22*b*, 22*c*, 22*d*) directed towards the one of the two structural parts, and the compressive-force-distributing element (20*a*, 20*b*) is produced from a material which has a level of thermal conductivity λ which is lower than 2.0 W/mK.

12 Claims, 6 Drawing Sheets

(56) References Cited

U.S. PATENT DOCUMENTS

| | | | | |
|---|---|---|---|---|
| 8,991,124 | B2 | 3/2015 | Braasch | |
| 2004/0083663 | A1 * | 5/2004 | Englekirk et al. ..... | 52/236.3 |

FOREIGN PATENT DOCUMENTS

| | | |
|---|---|---|
| DE | 19741027 | 3/1999 |
| DE | 19627342 | 6/2006 |
| DE | 102006032444 | 1/2008 |
| DE | 102007014922 | 9/2008 |
| DE | 102008049868 | 4/2009 |
| DE | 102008029701 | 12/2009 |
| EP | 1225282 | 7/2002 |
| EP | 2138641 | 12/2009 |
| EP | 2177681 | 4/2010 |
| EP | 2354343 | 8/2011 |
| WO | 2008113348 | 9/2008 |

* cited by examiner

STRUCTURAL ELEMENT FOR HEAT-INSULATING PURPOSES

BACKGROUND

The present invention relates to a structural element for thermal insulation.

The prior art already discloses various embodiments of structural elements for thermal insulation with a separate compressive-force-distributing element which ensures that the compressive force can be transmitted over as large a surface area as possible between load-bearing element and adjoining structural part. Thus, in the early days of such structural elements for thermal insulation, load-bearing elements had a load-bearing bar passing through the insulating body plane and load-bearing plates welded onto the end sides of the load-bearing bar, see for example DE-A-41 03 278.

In the subsequent period, however, designs were also proposed in which the load-bearing webs and the compressive-force-distributing elements were arranged movably with respect to one another, as is described, for example, in DE-A-40 09 987, where the load-bearing web is formed of a metal bar adjoined by sleeve-like compressive-force-distributing elements on the end sides, and the load-bearing web and the two compressive-force-distributing elements are articulatedly connected to one another—at least after a mutual positional securement provided for mounting purposes has been removed. This positional securement comprises end projections of the load-bearing web which extend in corresponding openings in the sleeve-like compressive-force-distributing elements and are fixed there in the form of rivets. This ensures that these three elements, that is to say the load-bearing web and the end compressive-force-distributing elements maintain the position predetermined or intended for them until after the attachment of the adjoining structural parts and until the first actual loading case, which leads to a lateral shearing movement of these rivet-like projections. A disadvantage here, however, is that the shearing can in no case take place flush with the end surface of the load-bearing elements and that also the opening for the position-securing projection is provided exactly in the region where the load-bearing web bears against the compressive-force-distributing element, that is to say an optimum movement and force-introduction surface is likewise not available there. Consequently, in this embodiment known from DE-A-40 09 987, the compressive-force-distributing element can admittedly transmit compressive forces over a large area and introduce them into a load-bearing web which is correspondingly optimized in terms of thermal insulation and has as minimum a cross section as possible, and also compressive-force-distributing elements and load-bearing webs can participate in mutual relative movements in a virtually transverse-force-free manner as a result of the articulated connection without there resulting in an impairment of the function in the compressive-force transmission. However, the compressive-force transmission is in need of improvement as a result of the disturbed or less optimized mutually facing bearing faces.

In the prior art, DE-A-196 27 342 discloses a further embodiment of a load-bearing element with a compressive-force-distributing element in which the compressive-force-distributing element comprises a plate-shaped structural part which is connected by a dovetail-shaped positive connection to the end side of an associated load-bearing web and can thus follow relative movements running in the horizontal direction in a virtually transverse-force-free manner, while at the same time maintaining the compressive-force transmission function. Although the abovementioned dovetail-shaped configuration of the positive connection between compressive-force-distributing element and load-bearing web ensures on the one hand a good positional securement in the installed and transported state, on account of the numerous large-area bearing regions between compressive-force-distributing element and load-bearing web it leads very quickly to constraints, especially if no exact horizontal relative movement between load-bearing element and associated structural part takes place, but a, for example, slight inclination or tilting. The constraints arising here lead to corresponding transverse forces right up to destructions of the load-bearing web or the compressive-force-distributing element in the mutual bearing region.

Furthermore, it should be noted that in the meantime the known solutions with an additional compressive-force-distributing element have succeeded in optimizing the compressive-force transmission by structural elements for thermal insulation of the generic type and nevertheless in not or only barely preventing temperature-induced relative movements between the adjoining structural parts. For all the targeted optimization of the compressive-force transmission and simultaneous maintenance of movability, however, in the past a further optimization with regard to thermal insulation has moved somewhat out of focus, which since the beginning was the main reason for the developments in the field of structural elements for thermal insulation. In this regard, the cross-sectionally reduced load-bearing webs of the prior art were already solidly based on the finding that a better thermal insulation is associated with as small a cross-sectional area as possible in the region of the load-bearing web. In other words, the smaller the cross section in a given load-bearing web material, the smaller also the heat transfer, that is to say the heat transmitted by the load-bearing web.

Nevertheless, however, in order to maintain the compressive-force transmission required, a certain degree of force-introduction surface at the ends is required. For this reason, the prior art discloses load-bearing elements in which the load-bearing webs, with a reduced cross-sectional area in a central region, are again provided at the ends with a larger cross section, see for example EP 1 225 282 A2.

Taking this as the starting point, the present invention is based on the object of making available a structural element of the type mentioned at the outset which is optimized in terms of the compressive-force transmission on the one hand and the thermal insulation on the other hand while maintaining the absorption of relative movements in the region of the load-bearing element.

SUMMARY

This object is achieved according to the invention by a structural element for thermal insulation according to one or more features of the invention.

Advantageous developments of the invention are in each case the subject matter of the dependent claims whose wording is hereby incorporated by express reference in the description in order to avoid unnecessary repetitions of text.

According to the invention, the compressive-force-distributing element is produced from a material which has a thermal conductivity $\lambda$ which is lower than 2.0 W/mK, with the result that it has a thermal conductivity which is lower, i.e. better, than the reinforced concrete usually used. This requirement is based on the finding that a compressive-force introduction region for the load-bearing element, which region simultaneously has a considerably improved thermal insulation property, is to be connected upstream of the adjoining structural part, which usually is formed of a reinforced concrete, in particular of a concrete of the strength class C20/25 according to DIN 1045-1 or higher. In other words, the load-bearing element according to the invention delivers a compressive-force introduction region for the adjoining structural part in the form of the compressive-force-distributing element, that is to say replaces the corresponding region of the adjoining structural part by a dedicated region with optimized properties. In order that this therefore leads not only to an improved compressive-force introduction, but also to improved thermal insulation properties, the compressive-force-distributing element is designed according to the invention with a thermal conductivity λ of below 2.0 W/mK.

It is particularly preferred if the material of the compressive-force-distributing element has a thermal conductivity λ which is lower than 1.6 W/mK and in particular lower than 1.0 W/mK. In this regard, the prior art already discloses using, instead of conventional load-bearing elements of steel, in particular stainless steel, high-strength or ultra-high-strength concretes for optimizing the thermal insulation, which concretes have not only a better compressive load-bearing capacity and thus require a lower cross section for the required compressive-force distribution, but also a lower thermal conductivity than steel. If the high-strength or ultra-high-strength concrete or mortar is used not only as material of the load-bearing webs, but also for the material of the compressive-force-distributing element, not only can the load-bearing capacity be improved via the improved compressive-force introduction into the adjoining structural parts, but at the same time also the thermal insulation in the force-introduction region.

It is particularly advantageous for equipping and mounting the structural element for thermal insulation if the load-bearing element has a position-securing element and the compressive-force-distributing element can be positioned on the load-bearing web via the position-securing element. As a result, it is possible in a particularly advantageous manner to continue to operate the functional separation already begun by the separate compressive-force-distributing element and to provide an additional position-securing element, with the result that thus neither the load-bearing web nor the compressive-force-distributing element itself must ensure the positional securement, but that this is effected via a separate structural part.

Hence, load-bearing web and compressive-force-distributing element can be further optimized in terms of the compressive-force-distributing function intended for them. For example, the load-bearing element can have as minimum a cross section as possible which leads to an accordingly reduced transmission of heat or cold through the structural part gap or the insulating body arranged therein. However, in order to improve the compressive-force transmission at the same time, the load-bearing web does not itself have to have as large a compressive-force introduction area at the ends, but can ensure this by the use of the separate compressive-force-distributing element, which can be designed correspondingly with a large area. In order that the compressive-force transmission can now take place between load-bearing web and separate compressive-force-distributing element in an optimum manner, the position-securing element provided according to the invention ensures that both structural parts are installed in the mutual orientation and position intended for them, wherein this position-securing element can also provide for any desired relative movability between compressive-force-distributing element and load-bearing web.

Advantageously, the compressive-force-distributing elements can thus be fixed by in each case a position-securing element in the region of the end side on the load-bearing web, wherein expediently the actual fixing takes place outside the compressive-force transmitting region, that is to say in particular outside the end sides.

A particular advantage results when the position-securing element comprises a mold and the compressive-force-distributing element and/or the load-bearing web is formed of a curing and/or settable filling material which can be introduced into the mold, in particular of a cement-containing, fiber-reinforced building material such as concrete, such as high-strength or ultra-high-strength concrete or such as high-strength or ultra-high-strength mortar or of a synthetic resin mixture or of a reaction resin. It is thereby ensured that the position-securing element and the compressive-force-distributing element on the one hand and/or the position-securing element and the load-bearing web on the other hand are arranged in an exactly fitting manner with respect to one another. If then, in a preferred exemplary embodiment, the mold is installed together with the compressive-force-distributing element and/or the load-bearing web, the position-securing element thus forms a lost mold it can thus be ensured that the optimal bearing of the compressive-force-distributing element and/or the load-bearing web against the position-securing element is also maintained after the installation and the mold makes available a tolerance-free surface optimally adapted to the surface of the compressive-force-distributing element and/or the load-bearing web.

Further advantages result from the fact that the position-securing element forms a sliding layer between the compressive load-bearing web and the compressive-force-distributing element; if thus the position-securing element is already present in any case, it can, in a manner according to the invention, also assume the function of a sliding layer which is often in any case present in movably mounted load-bearing elements. Since, in the usual applications, the sliding layer also has to be fixed there in a positionally-secured manner on the load-bearing element, it is particularly advantageous in the present case if this can take place by means of the position-securing element according to the invention, the sliding layer thus itself being formed of the position-securing element. The sliding layer in this context is not to be understood as any thin-layered application of a coating on load-bearing web and/or compressive-force-distributing element but a physical layer which can be formed according to the invention of the position-securing element and in particular of the aforementioned mold. In this case, the sliding layer usually has a layer thickness in the order of magnitude of a few tenths of a millimeter and preferably 0.5 mm and above.

It is in this case within the scope of the present invention if the position-securing element comprises a mold for the load-bearing element, as is known, for example, from EP-A-1 225 282 A2, only that now the mold must meet the further function of the position-securing element and for this purpose must be connected to a separate compressive-force-distributing element.

It is possible and regularly also expedient here for both load-bearing web and compressive-force-distributing element to be produced by one and the same mold. Likewise, however, it is of course also possible to produce only one of the two elements by the mold and to prefabricate the respective other element, for example.

As already mentioned, the load-bearing web and the compressive-force-distributing element can be articulatedly connected to one another with the interposition of the position-securing element, in which case the position-securing element can then form a sliding layer for the swinging or pivoting movement between load-bearing web and compressive-force-distributing element.

In this context, it is recommended that the load-bearing web has at its end side a contact profile which faces the structural part and is concavely or convexly curved in vertical section and/or in horizontal section, and that the compressive-force-distributing element has a convexly or concavely curved force-introduction face oppositely adapted in shape to the contact profile in vertical section and/or in horizontal section, such that load-bearing web and compressive-force-distributing element bear flat against one another along a curved surface. If this curving has a circular-arc shape, there can thereby be made available an articulated movement of the load-bearing web with respect to the compressive-force-distributing element along the surface curved in a circular-arc shape.

It is particularly recommended if the compressive-force-distributing element is arranged completely or at least predominantly in the adjoining structural part; then, the load-bearing web can be restricted to the region of the insulating body and the compressive-force-distributing element can be moved along with the adjoining structural part by means of a positive or cohesive connection, with the result that then the relative movement preferably takes place in the edge region of the insulating body, that is to say in the parting surface between insulating body and structural part. For this purpose, it is thus recommended that the load-bearing web terminates by its end face facing the adjacent structural part at least approximately flush with the insulating body side face.

As an alternative to this, the compressive-force-distributing element can of course also be arranged in the region of the structural part gap, that is to say in the insulating body region, wherein it would nevertheless also be advantageous in this embodiment to fixedly connect the compressive-force-distributing element to the adjoining structural part in such a way that any relative movement between the adjoining structural parts is transmitted from the compressive-force-distributing element to the bearing region between load-bearing web and compressive-force-distributing element and thus takes place in the sliding layer region formed by the position-securing element, which region is optimized in terms of movability and accuracy of fit.

In this connection, it is recommended that the position-securing element be formed of plastic, in particular of HD polyethylene, which has optimum strength values combined with correspondingly optimal surface/sliding properties.

Furthermore, it is within the scope of the present invention that the position-securing elements assigned to the two mutually opposite end sides of a load-bearing web are connected to one another for example via a connecting element, such that as a result a unit consisting of load-bearing web, compressive-force-distributing elements each connected at the ends and associated position-securing elements with connecting element can be made available, and this unit can be jointly inserted into the insulating body region which is provided for it. As an alternative to this, however, it is of course also possible to arrange the individual parts successively in the insulating body, for example if the position-securing element comprises a mold and the respective element is to be produced only in the inserted state of the position-securing element in the insulating body. Finally, it is also possible by means of the present invention to provide a common position-securing element for two load-bearing webs which are horizontally adjacent to one another, in particular arranged next to one another, wherein a separate compressive-force-distributing element can be made available either for each load-bearing web by the common position-securing element or else a common compressive-force-distributing element for the two adjacent load-bearing webs.

BRIEF DESCRIPTION OF THE DRAWINGS

Further features and advantages of the present invention will emerge from the following description of an exemplary embodiment with reference to the drawing, in which.

DETAILED DESCRIPTION OF THE PREFERRED EMBODIMENTS

Figure 1A:
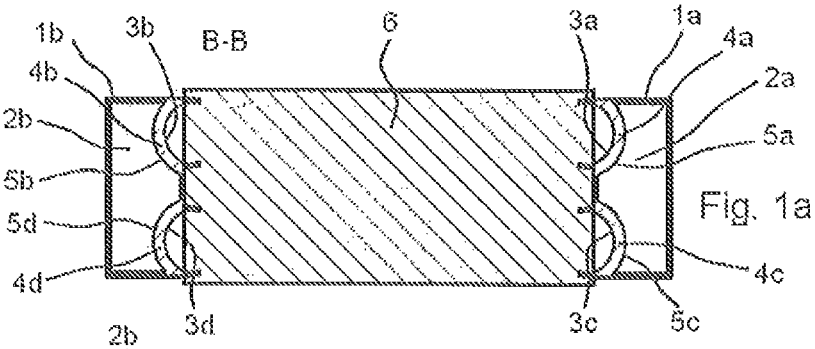
FIGS. 1*a*-1*e* show a position-securing element for a structural element for thermal insulation according to the invention in FIG. 1*d* in a perspective plan view, in FIG. 1*b* in vertical section, in FIG. 1*a* in horizontal section along the plane B-B from FIG. 1*b*, in FIG. 1*c* in horizontal section along the plane A-A from FIG. 1*b* and in FIG. 1*e* in perspective plan view of a section along the plane A-A from FIG. 1*b;*
Figure 1B:
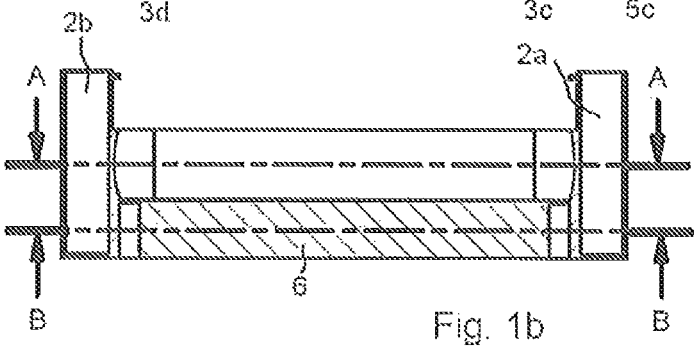
Figure 1C:
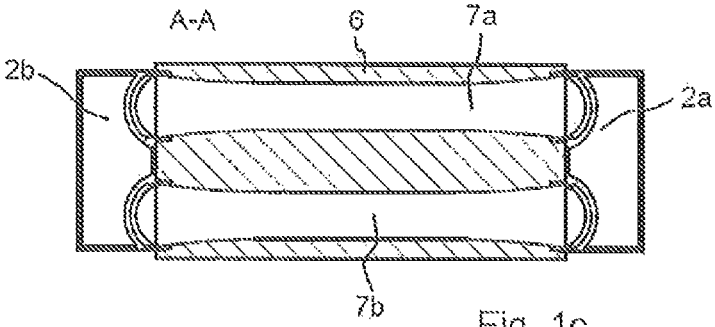
Figure 1D:
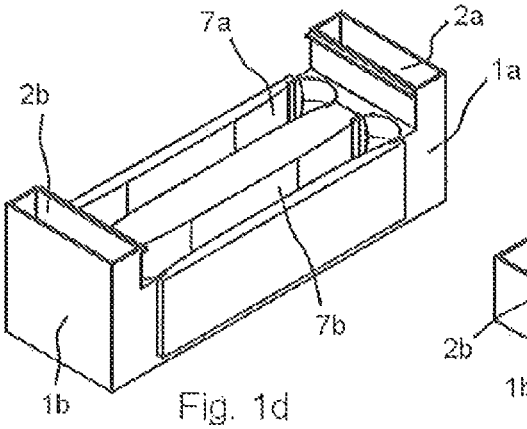
Figure 1E:
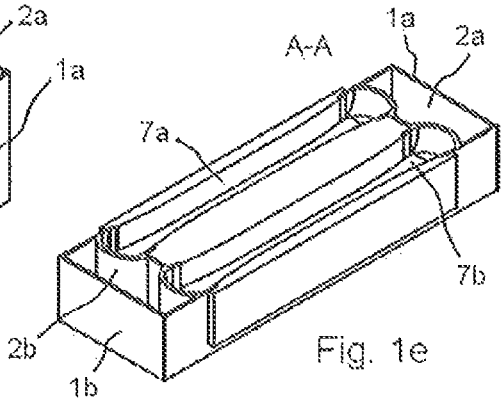
Figure 2:
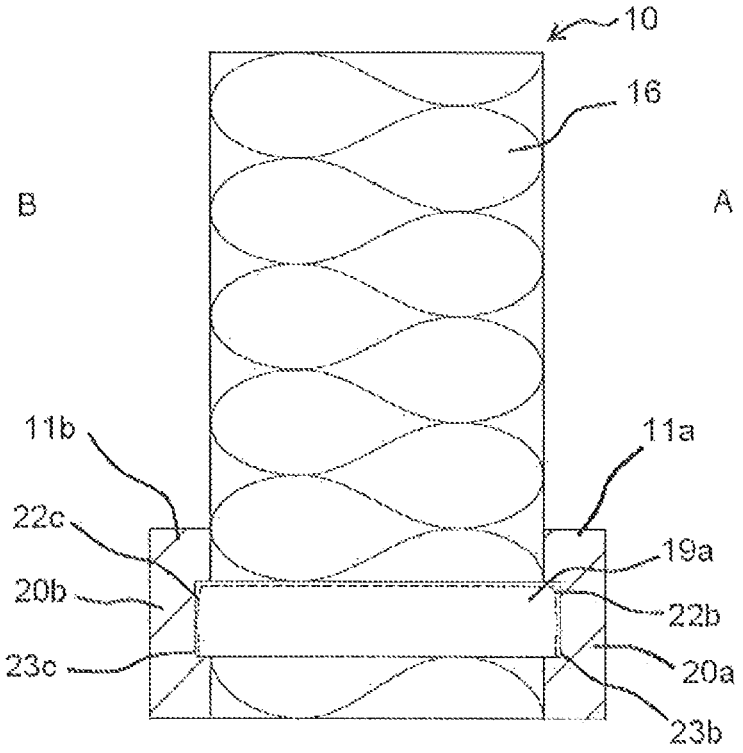
FIG. 2 shows a load-bearing element of a structural element for thermal insulation according to the invention in side view with a load-bearing web and compressive-force-distributing elements and position-securing elements connected at the ends.
Figure 3:
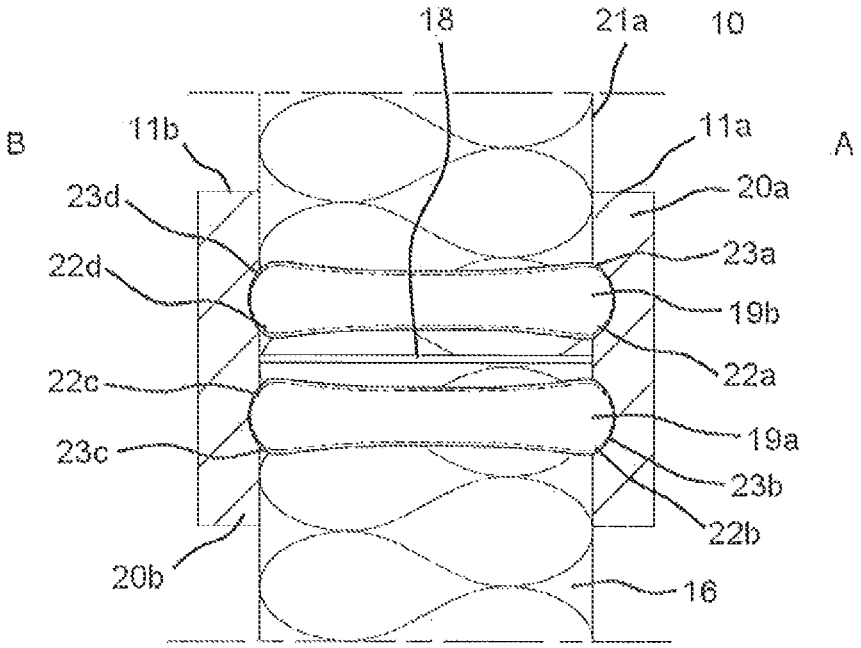
FIG. 3 shows the load-bearing element from FIG. 2 with a load-bearing web, position-securing elements and compressive-force-distributing elements in plan view.

FIGS. 2 and 3 illustrate the lower subregion of a structural element 10 according to the invention with a parallelepipedal insulating body 16 and load-bearing webs 19*a*, 19*b* running through the insulating body in the horizontal direction and perpendicular to its longitudinal extent, wherein the load-bearing webs 19*a*, 19*b* illustrated in dashed lines in FIGS. 2 and 3 are arranged adjacent and parallel to one another in the horizontal direction, extend from an adjoining structural part A, for example a floor slab, to an opposite adjoining structural part B, for example a balcony slab, and, for mutual compressive force transmission, project slightly with respect to the insulating body plane into the planes of the structural parts A, B with end sides 22*a*, 22*b*, 22*c*, 22*d* curved in a circular-arc shape.

Now, according to the invention, in each case a compressive-force-distributing element 20*a*, 20*b* is provided in the region of the structural parts A, B in the region of the end sides of the load-bearing elements 19*a*, 19*b*, which compressive-force-distributing element serves for introducing compressive force or removing compressive force between the load-bearing elements 19*a*, 19*b* and the adjoining structural parts A, B. In the exemplary embodiment shown, two load-bearing webs 19*a*, 19*b* and two compressive-force-distributing elements 20*a*, 20*b* together form a load-bearing element 12. For the sake of completeness, it should be noted in this regard that it is also within the scope of the invention that load-bearing elements have only one load-bearing web and in total two compressive-force-distributing elements each connected to the ends of the load-bearing web.

The compressive-force-distributing elements 20*a*, 20*b* terminate substantially flush with the side faces of the structural parts A, B and thus, in the installed state, run along the side faces 21*a*, 21*b* of the insulating body 16. It is only in the region of the load-bearing elements that they return somewhat from this flush extent and are there adapted to the end sides 22*a*, 22*b*, 22*c*, 22*d* of the load-bearing elements 19*a*, 19*b* curved in a circular-arc shape and thus have complementary circular-arc-shaped returns 23*a* to 23*d* adapted thereto.

As can be seen in particular from the plan view in FIG. 3, the load-bearing elements bear with their circular-arc-shaped convex end sides flat against the above-mentioned returns of the compressive-force-distributing elements and form an articulated connection therewith, through which connection it is possible that the structural parts A and B are displaced parallel to one another in the horizontal direction and the load-bearing elements 19*a*, 19*b* therefore follow the displacement movement in a virtually transverse-force-free manner by slight tilting.

It is thus essential to the invention that the compressive-force-distributing elements consist of a material which has a thermal conductivity λ which is lower than 2.0 W/mK. In the exemplary embodiment illustrated in the drawing, an embodiment is shown with compressive-force-distributing elements formed of high-strength concrete and thus a thermal conductivity in the order of magnitude of only 0.8 W/mK. By contrast, the in situ concrete of the concrete structural part A, B adjoining this has a thermal conductivity λ of approximately 2.1 W/mK. It can be quickly and readily discerned from this that the compressive-force-distributing element according to the invention constitutes an insulating layer for the adjoining structural part; it thus maintains the thermal conductivity which is already considerably reduced in the region of the load-bearing web (in the present exemplary embodiment, the load-bearing webs also is formed of high-strength concrete with a thermal conductivity in the order of magnitude of only 0.8 W/mK) right into the region of the adjoining structural part.

It is also essential to the invention that position-securing elements 11*a*, 11*b* are arranged between the load-bearing elements 19*a*, 19*b* and the compressive-force-distributing elements 20*a*, 20*b*, which position-securing elements mutually position the load-bearing webs 19*a*, 19*b* and the compressive-force-distributing elements 20*a*, 20*b* and preferably also fix them. In the exemplary embodiment shown, these position-securing elements 11*a*, 11*b* comprise a mold for the load-bearing webs 19*a*, 19*b* and for the compressive-force-distributing elements 20*a*, 20*b* and they correspond to the position-securing elements 1*a*, 1*b* from FIG. 1 which is described in detail below.

In the exemplary embodiment from FIGS. 2 and 3, the position-securing elements form a sliding layer between the load-bearing elements 19*a*, 19*b* and the compressive-force-distributing elements 20*a*, 20*b*, by means of the which the static friction in the mutual bearing region of the load-bearing webs and the compressive-force-distributing elements is considerably reduced, with the result that a sliding pivoting movement is possible without significant adhesive effects and transverse forces caused thereby.

In FIGS. 2 and 3, the position-securing elements 11*a*, 11*b* functioning as a mold for the compressive-force-distributing elements can be seen only as outlines of the compressive-force-distributing elements 20*a*, 20*b*, it being clear that these have overall an approximately parallelepipedal outer contour with the circular-arc-shaped returns serving as sliding layers 14*a*, 14*b*, 14*c*,14*d*, against which returns there bear the corresponding end sides 22*a* to 22*d* of the load-bearing elements 19*a*, 19*b* on the one hand and the opposite returns of the compressive-force-distributing elements 20*a*, 20*b*, namely the surfaces 23*a* to 23*d* there.

In FIG. 1, a part of a structural element for thermal insulation according to the invention is illustrated, namely a position-securing element 1*a*, 1*b* which comprises a mold 13 with a cavity 2*a*, 2*b* in which concrete, in particular high-strength or ultra-high-strength concrete for a compressive-force-distributing element (not shown in FIG. 1) can be filled, and with a cavity 7*a*, 7*b* in which concrete, in particular high-strength or ultra-high-strength concrete for a load-bearing web (not shown in FIG. 1) can be filled.

The mold 13 has not only the cavities 2*a*, 2*b*, 7*a*, 7*b* of the position-securing element but also curved surfaces 3*a*, 3*b*, 3*c*, 3*d* which function as mold part of two load-bearing elements (not shown in FIG. 1), more precisely for the end sides of the two load-bearing elements. In this curved surface region 3*a*-3*d*, the position-securing element 1*a*, 1*b* thus forms a sliding layer 4*a*, 4*b*, 4*c*, 4*d* for the force-transmitting and bearing region between compressive-force-distributing element on the one hand and the individual end sides of the load-bearing web on the other hand. As a result of the curved circular-arc shape of these sliding layers 4*a* to 4*d* both on the surfaces 3*a* to 3*d* facing the load-bearing webs and on the opposite surfaces 5*a* to 5*d* assigned to the compressive-force-distributing element, the load-bearing webs and the associated compressive-force-distributing elements bear in an articulated manner against one another and can carry out relative movements with respect to one another along the circular-arc shape and thereby ensure that the compressive forces can furthermore be transmitted in a transverse-force-free manner via the sliding layer between load-bearing web and compressive-force-distributing element.

FIG. 1 also illustrates an insulating body subregion 6 which bears the load-bearing webs (not shown in FIG. 1) in particular on its underside and can likewise function as a mold for the load-bearing webs partially by means of corresponding recesses 7*a*, 7*b*, in that the recesses 7*a*, 7*b* correspond to the shape intended for the load-bearing webs. The mold for the regions of the load-bearing webs that extend above the insulating body subregion 6 are likewise not shown in FIG. 1. The drawing does not show a connecting element which serves to connect the two position-securing elements 1*a*, 1*b* to one another. This can extend for example in the horizontal direction in the form of a bar from one position-securing element 1*a* to the other position-securing element 1*b* through the insulating body 6. As a result, the distance between the end mold surfaces 3*a* to 3*d* and thus the length of the associated load-bearing webs is predetermined, which corresponds approximately to the width of the insulating body 6.

To the connecting web not shown in FIG. 1 there corresponds, in FIG. 3, a connecting web 18 which is arranged between the two position-securing elements 11*a*, 11*b* and by means of which the load-bearing webs 19*a*, 19*b* are held between the load-distributing elements 11*a*, 11*b* during production, transport and installation and are thus arranged in the predetermined orientation and position with respect to the compressive-force-distributing elements 20*a*, 20*b*.

Figure 4:
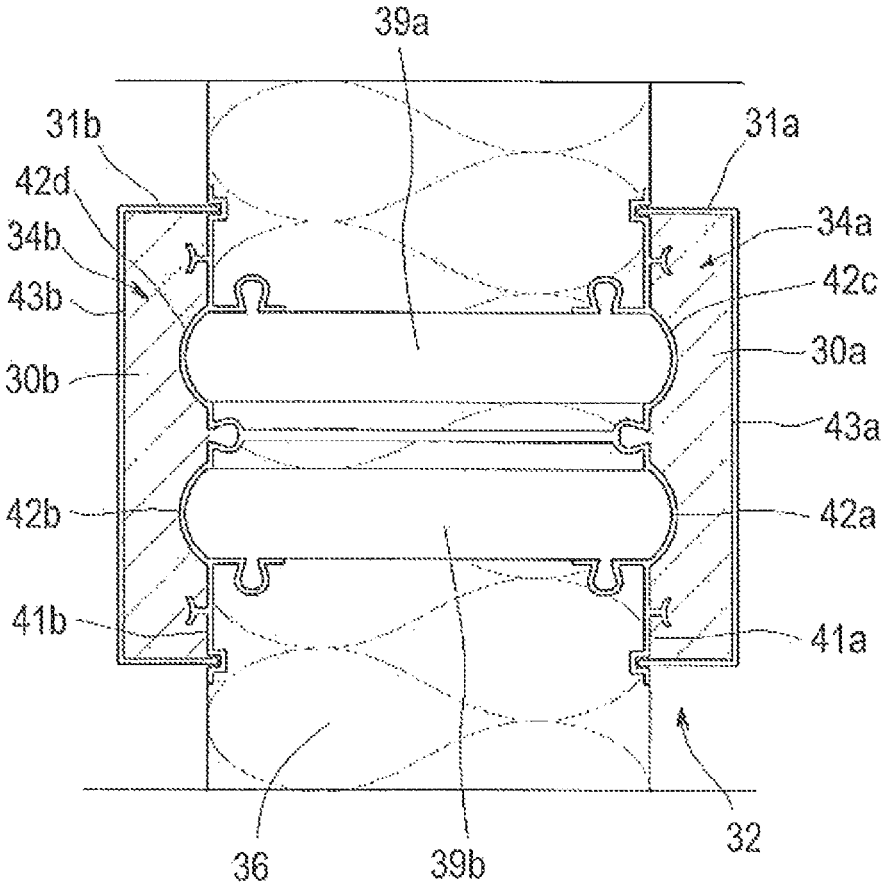
FIG. 4 shows an alternative embodiment of a load-bearing element of a structural element for thermal insulation according to the invention in plan view.

FIG. 4 furthermore shows parts of a further embodiment of a structural element for thermal insulation according to the invention with alternative position-securing elements 31*a*, 31*b*, with a load-bearing element 32 comprising two parallel load-bearing webs 39*a*, 39*b* and two end compressive-force-distributing elements 30*a*, 30*b*, and with an insulating body 36 in sectioned plan view. Although the alternative position-securing elements 31*a*, 31*b* here likewise serve as a mold 33*a*, 33*b* with cavities 34*a*, 34*b* for the compressive-force-distributing elements 30*a*, 30*b*, they do not do so for the load-bearing webs 39*a*, 39*b*. Here, each position-securing element is of multipart design and comprises a wall 41*a*, 41*b* extending along the insulating body outer side 36, the sliding layers 42*a*, 42*b*, 42*c*, 42*d* acting on the load-bearing webs 39*a*, 39*b* on the end sides, and an additional profile body 43*a*, 43*b* which is U-shaped in horizontal section. Finally, the cavities are bounded on the underside by a base surface (not shown in FIG. 4).

By contrast, the load-bearing webs formed of concrete elements which are prefabricated without the involvement of the mold 33 or the position-securing elements 31*a*, 31*b*. They are enclosed in the region laterally with respect to their end sides 42*a*, 42*b*, 42*c*, 42*d* by the position-securing elements 31*a*, 31*b* and are thus fixed in the predetermined position with respect to the compressive-force-distributing elements 30*a*, 30*b*.

Figure 5:
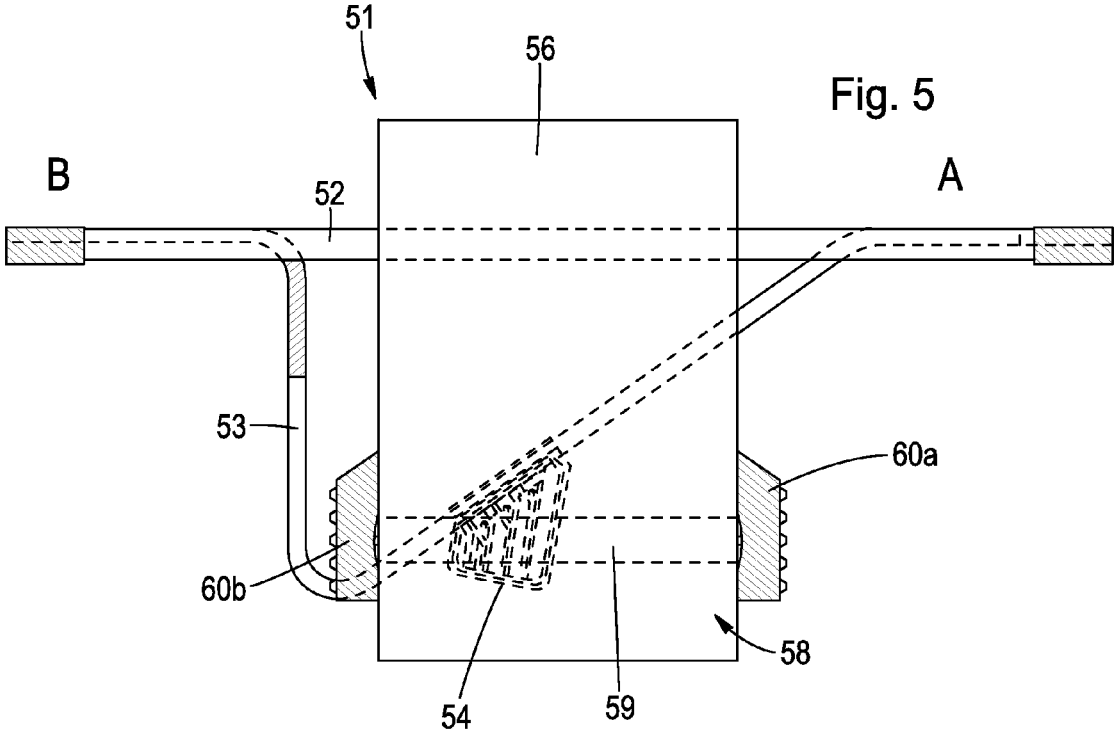
FIG. 5 shows an embodiment of a structural element for thermal insulation according to the invention in side view.
Figure 6:
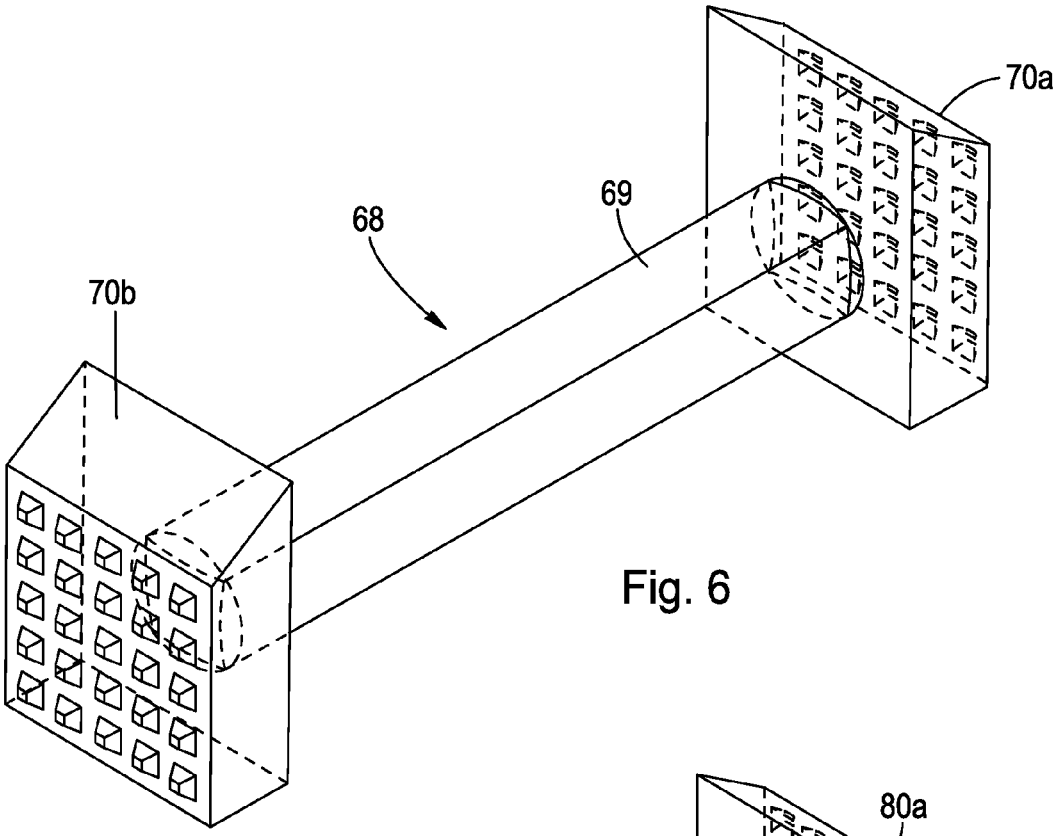
FIGS. 6-8 show various embodiments of a load-bearing element of a structural element for thermal insulation according to the invention in perspective side view.

FIG. 5 now illustrates a structural element 51 for thermal insulation according to the invention completely in side view with a parallelepipedal insulating body 56 which extends in a horizontal direction along the gap left between two structural parts A and B, and with reinforcing elements in the form of tension bars 52, transverse-force bars 53 and load-bearing elements 58. The tension bars and the transverse-force bars are formed in the usual manner of steel, namely of stainless steel in the region of the gap between the two structural parts A and B, i.e. in the region of the insulating body 56, and of concrete-reinforcing steel in the region far outside the insulating body, that is to say in the region of the structural parts A and B, as is indicated by the different hatchings of the two reinforcing bars in FIG. 5. They are arranged in the manner which is usual in the prior art relative to the structural element for thermal insulation, namely, in the case of the tension bars, in an upper region of the insulating body, the so-called tension zone, in the horizontal direction perpendicular to the longitudinal extent of the insulating body and, in the case of the transverse-force bars, starting from the tension zone of the supporting structural part, obliquely inclined downward through the insulating body into the lower load-bearing zone and from there, outside the insulating body, again vertically upward to the tension zone of the supported structural part.

By contrast thereto, the load-bearing elements 58 are designed differently by comparison with the known load-bearing elements. They comprise load-bearing webs 59 extending through the insulating body 56 in the horizontal direction and perpendicular to its longitudinal extent, which load-bearing webs extend in the horizontal direction from an adjoining structural part A, for example a floor slab, to an opposite adjoining structural part B, for example a balcony slab, and compressive-force-distributing elements 60*a*, 60*b* arranged on the end sides of the load-bearing webs 59. The compressive-force-distributing element 60*b* assigned to the structural part B serves to absorb the compressive force of the supported structural part B and to introduce it into the load-bearing web 59, whereas the compressive-force-distributing element 60*a* assigned to the structural part A serves to transmit the compressive force from the load-bearing web 59 into the structural part A and to introduce it there.

The compressive-force-distributing elements are formed from high-strength or ultra-high-strength concrete and thus have the advantageous thermal conductivity according to the invention. In the exemplary embodiment of FIG. 5, the load-bearing web 59 is also formed from the same material as the compressive-force-distributing elements 60*a*, 60*b*.

For the sake of completeness, it should also be mentioned that the transverse-force bars 53 have in a manner known per se in their inclined profile a position-fixing sleeve 54 via which they are secured with respect to the insulating body 56 and/or the load-bearing web 59 in order thereby to prevent an unintentional change in their installed position, in particular a displacement or rotation.

FIGS. 6, 7, 8 and 9 show alternative embodiments of load-bearing elements 68, 78 and 88 which more or less correspond to or resemble the embodiment of the load-bearing element 58 of FIG. 5. The load-bearing element 68 illustrated in FIG. 6 with the rectangular load-bearing web 69 and the compressive-force-distributing elements 70*a*, 70*b* connected to its free ends corresponds to the embodiment of the load-bearing element 58 from FIG. 5, wherein the compressive-force-distributing elements 60*a*, 60*b*, 70*a*, 70*b* are each designed in the form of plates. Here, the plate thickness influences the insulating behavior in that in this region—as can be seen from FIG. 5—the material of the structural part A, B, that is to say in particular the in situ concrete with its poor thermal conductivity, is replaced by the insulating material of the compressive-force-distributing elements.

Figure 7:
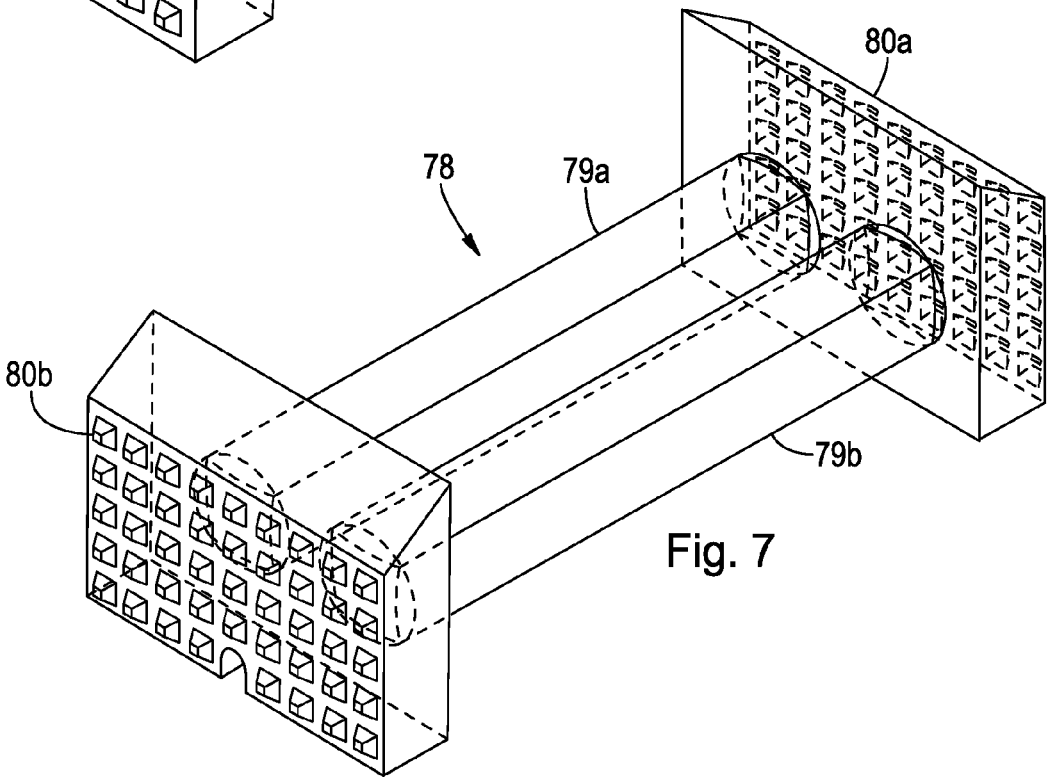

FIG. 7 shows a load-bearing element 78 corresponding to the load-bearing element 59 from FIG. 5 with the sole difference that the load-bearing element 78 comprises two parallel load-bearing webs 79*a* and 79*b* which interact with common end compressive-force-distributing elements 80*a*, 80*b*.

Figure 8:
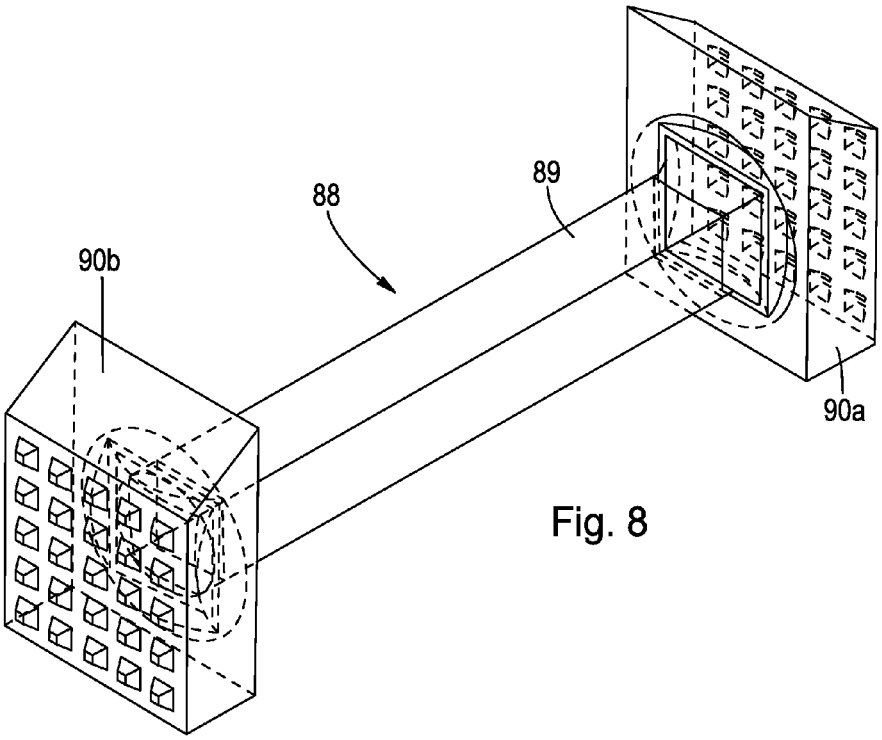
Figure 9:
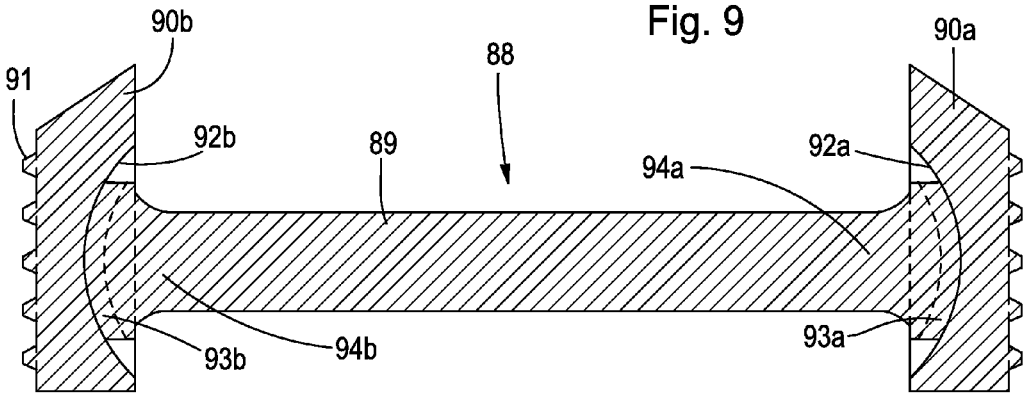
FIG. 9 shows the load-bearing element from FIG. 8 in a sectional side view.

FIG. 8 illustrates a load-bearing element 88 in which likewise a rectangular load-bearing web 89, that is to say a cylindrical load-bearing web with a square vertical cross section, interacts with plate-shaped compressive-force-distributing elements 90*a*, 90*b*. The difference in relation to the load-bearing elements 58, 68 consists only in that the load-bearing web 89 has cross-sectional enlargements at its terminal free ends 94*a*, 94*b* in order thereby to form a larger contact profile 93*a*, 93*b* for the adjoining compressive-force-distributing element 90*a*, 90*b*. Here, there can be seen from the vertical section in FIG. 9 a circular segment shape in the mutual bearing region between the convexly curved contact profile 93*a*, 93*b* of the load-bearing web 89 and the oppositely concavely curved force-introduction face of the compressive-force-distributing element 90*a*, 90*b*, which circular segment shape allows an articulated movable bearing and compressive-force transmission in these regions.

Moreover, the vertical section also makes it possible to see profilings 91 at the end sides of the compressive-force-distributing element which face the respective structural part, which profilings ensure an improved connection between compressive-force-distributing element and associated structural part. This results in the essential advantage that the compressive-force-distributing elements may extend within the structural part far downward until almost or completely reaching its lower edge, without having to observe the minimum concrete covering which has to be taken into account otherwise. This results in the advantage that the load-bearing element may be arranged far downwardly within the structural element for thermal insulation with a greater lever arm with respect to the tensile reinforcement than in comparable cases, in particular with load-bearing elements made of steel.

In summary, the present invention offers the advantage of making available load-bearing elements with additional separate compressive-force-distributing elements which ensure optimum compressive-force introduction or transmission with at the same time optimum or considerably improved thermal insulation in that they are produced from a material which has a thermal conductivity $\lambda$ which is lower than 2.0 W/mK, preferably lower than 1.6 W/mK and in particular lower than 1.0 W/mK.

The invention claimed is:

1. A structural element for thermal insulation between two structural parts, comprising an insulating body, which is to be arranged between the two structural parts, and reinforcing elements in the form of at least one load-bearing element which, with the structural element in the installed state, runs through the insulating body substantially horizontally and transversely to a substantially horizontal longitudinal extent of said insulating body, and is connectable at least indirectly to and carries a compressive load between each of the two structural parts, the load-bearing element comprises at least one load-bearing web having two end sides, each of the end sides having a contact profile which faces a respective one of the structural parts and is concavely or convexly curved in at least one of a vertical section or a horizontal section, and a separate compressive-force-distributing element at each of the two end sides facing one of the two structural parts, the compressive-force-distributing element including a convexly or concavely curved force-introduction face oppositely adapted in shape to the contact profile in at least one of a vertical section or a horizontal section that receives the contact profile and being produced from a material which has a thermal conductivity $\lambda$ which is lower than 2.0 W/mK, the load-bearing element has a position-securing element, and the compressive-force-distributing element is positionable on the load-bearing web via the position-securing element, and the position-securing element forms a sliding layer between the load-bearing web and the compressive force distributing element.

2. The structural element for thermal insulation as claimed in claim 1, wherein the material of the compressive-force-distributing element has a thermal conductivity $\lambda$ which is lower than 1.6 W/mK.

3. The structural element as claimed in claim 1, wherein at least one of the compressive-force-distributing element or the load-bearing web is formed of at least one of a curing or settable filling material.

4. The structural element as claimed in claim 3, wherein the filling material comprises a cement-containing, fiber-reinforced building material, high-strength or ultra-high-strength concrete, high-strength or ultra-high-strength mortar, a synthetic resin mixture, or a reaction resin.

5. The structural element as claimed in claim 1, wherein the position-securing element comprises at least partially a mold, and the filling material for producing at least one of the load-bearing web or the compressive-force-distributing element is introducible into the mold.

6. The structural element as claimed in claim 1, wherein the load-bearing web and the compressive-force-distributing element are articulatedly connected to one another via the interposition of the position-securing element.

7. The structural element as claimed in claim 1, wherein the compressive-force-distributing element projects into a respective one of the structural parts at least with the end face facing away from the load-bearing web and has a surface with a friction coefficient increased by a profiling or roughening.

8. The structural element as claimed in claim 1, wherein the compressive-force-distributing element projects at least partially with respect to the insulating body in a direction of a respective one of the structural parts and is adapted to project at least partially into the respective structural part.

9. The structural element as claimed in claim 1, wherein the load-bearing web terminates by the end side at least approximately flush with the insulating body side face.

10. The structural element as claimed in claim 1, wherein the position-securing element is formed of plastic.

11. The structural element as claimed in claim 1, wherein the position-securing element assigned to the two mutually opposite end sides of the load-bearing web are connected to one another via a connecting element.

12. The structural element as claimed in claim 1, wherein two of the horizontally adjacent load-bearing webs have a common one of the compressive-force-distributing elements or of the position-securing elements.

* * * * *